US007033202B2

(12) United States Patent
Wu

(10) Patent No.: US 7,033,202 B2
(45) Date of Patent: Apr. 25, 2006

(54) CABLE END CONNECTOR HAVING LOCKING MECHANISM

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/387,902

(22) Filed: Mar. 12, 2003

(65) Prior Publication Data

US 2004/0180568 A1 Sep. 16, 2004

(51) Int. Cl.
*H01R 13/627* (2006.01)

(52) U.S. Cl. ..... 439/362

(58) Field of Classification Search ..... 439/362, 439/361, 359, 310, 339, 731, 906
See application file for complete search history.

(56) References Cited

U.S. PATENT DOCUMENTS 3,718,887 A * 2/1973 Solomon et al. ..... 439/362
5,342,216 A * 8/1994 Davis et al. ..... 439/362
5,647,758 A * 7/1997 Ichikawa et al. ..... 439/362
5,788,534 A 8/1998 Koegel et al. ..... 439/465
5,820,412 A 10/1998 Koegel et al.
6,059,599 A * 5/2000 Huang ..... 439/362
6,203,341 B1 * 3/2001 Chen ..... 439/362
2003/0073337 A1 * 4/2003 Guo ..... 439/362

* cited by examiner

*Primary Examiner*—Briggitte R. Hammond
(74) *Attorney, Agent, or Firm*—Wei Te Chung

(57) ABSTRACT

A cable end connector (1) includes an insulating housing (20) with a number of contacts (22) retained therein, a first cover (4) receiving the insulating housing therein, a second cover (3) assembled to the first cover, a pair of fastening members (5) and a pair of spring members (6). The first and second covers together define a pair of passages (45) to receive the fastening members therein. The fastening members have stop sections (500) movably received in engaging sections (47) of the passages. The spring members are received in the engaging sections to actuate the fastening members to move rearwardly when the cable end connector disengages from a complementary connector.

10 Claims, 9 Drawing Sheets

CABLE END CONNECTOR HAVING LOCKING MECHANISM

CROSS-REFERENCE TO RELATED APPLICATIONS

Relevant subject matter is disclosed in U.S. Pat. No. 6,589,066 filed on Jul. 30, 2002 and entitled "ELECTICAL CONNECTOR HAVING A LATCH MECHANISM", U.S. Pat. No. 6,722,912 filed on Jul. 31, 2002 and entitled "ELECTICAL CONNECTOR HAVING A LATCH MECHANISM", U.S. Pat. No. 6,702,602 filed on Sep. 4, 2002 and entitled "ELECTICAL CONNECTOR HAVING IMPROVED LATCH MECHANISM", U.S. Pat. No. 6,702,603 filed on Sep. 5, 2002 and entitled "ELECTICAL CONNECTOR HAVING ENGAGING DEVICE" and pending U.S. patent application Ser. No. 10/305,716 filed on Nov. 27, 2002 and entitled "ELECTRICAL CABLE CONNECTOR ASSEMBLY", all of which are invented by the same inventor as this patent application and assigned to the same assignee with this application.

BACKGROUND OF THE INVENTION

1. Field of the Invention

The present invention relates to an electrical connector, and particularly to a cable end connector having a locking mechanism for locking the cable end connector with a mating connector.

2. Description of Related Art

It is well known that a cable end connector terminates to an electrical cable and electrically connects with a complementary connector to transmit signals from the electrical cable to the complementary connector. The cable end connector and the complementary connector are often equipped with interlocking mechanisms to secure two mated connectors together.

U.S. Pat. Nos. 5,788,534 and 5,820,412, both issued to Koegel et al, each disclose a cable end connector having a pair of jackscrews assembled thereto. The jackscrew has an operating portion for being operated by a screw driver or by some other tools or by an operator's fingers, a threaded portion for engaging with a mating connector and a medial portion interconnecting the operating portion with the threaded portion. The cable end connector comprises a contact module terminating to an electrical cable and upper and lower covers enclosing the contact module. The lower cover defines a pair of first channels at two opposite lateral sides thereof. The upper cover defines a pair of second channels aligned with the first channels. The pair of jackscrews is first placed in the first channels of the lower cover and the upper cover is then assembled to the lower cover to enclose the jackscrews in a manner that allows the rotation and movement of the jackscrews. When the cable end connector mates with the mating connector, the operating portion is operated to rotatably and movably actuate the threaded section to engage with a locking nut of the mating connector.

When such mated connectors are subject to vibration/physical shock during use, the screw connection can become loosened thus allowing the connectors to become separated. However, the separation between the mated connectors cannot be easily detected. Thus, the user cannot immediately relock the mated connectors together once they are separated from each other. As a result, an electrical connection is adversely affected between the mated connectors.

Hence, a cable end connector with an improved locking mechanism is required to overcome the disadvantages of the related art.

SUMMARY OF THE INVENTION

Accordingly, a first object of the present invention is to provide a cable end connector having a locking mechanism to ensure a reliable lock between the cable end connector and a mating connector.

A second object of the present invention is to provide a cable end connector having a locking mechanism which can duly detect a loose between the cable end connector and a mating connector.

In order to achieve the objects set forth, a cable end connector in accordance with the present invention comprises an insulating housing with a plurality of contacts retained therein, a first cover receiving the insulating housing therein, a second cover assembled to the first cover, a pair of fastening members and a pair of spring members. The first and second covers together define a pair of passages at two lateral sides thereof to receive the fastening members therein. The fastening members have stop sections movably received in engaging sections of the passages. The spring members are received in the engaging sections and abut against the stop sections to actuate the fastening members to move rearwardly when the cable end connector disengages from a complementary connector.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
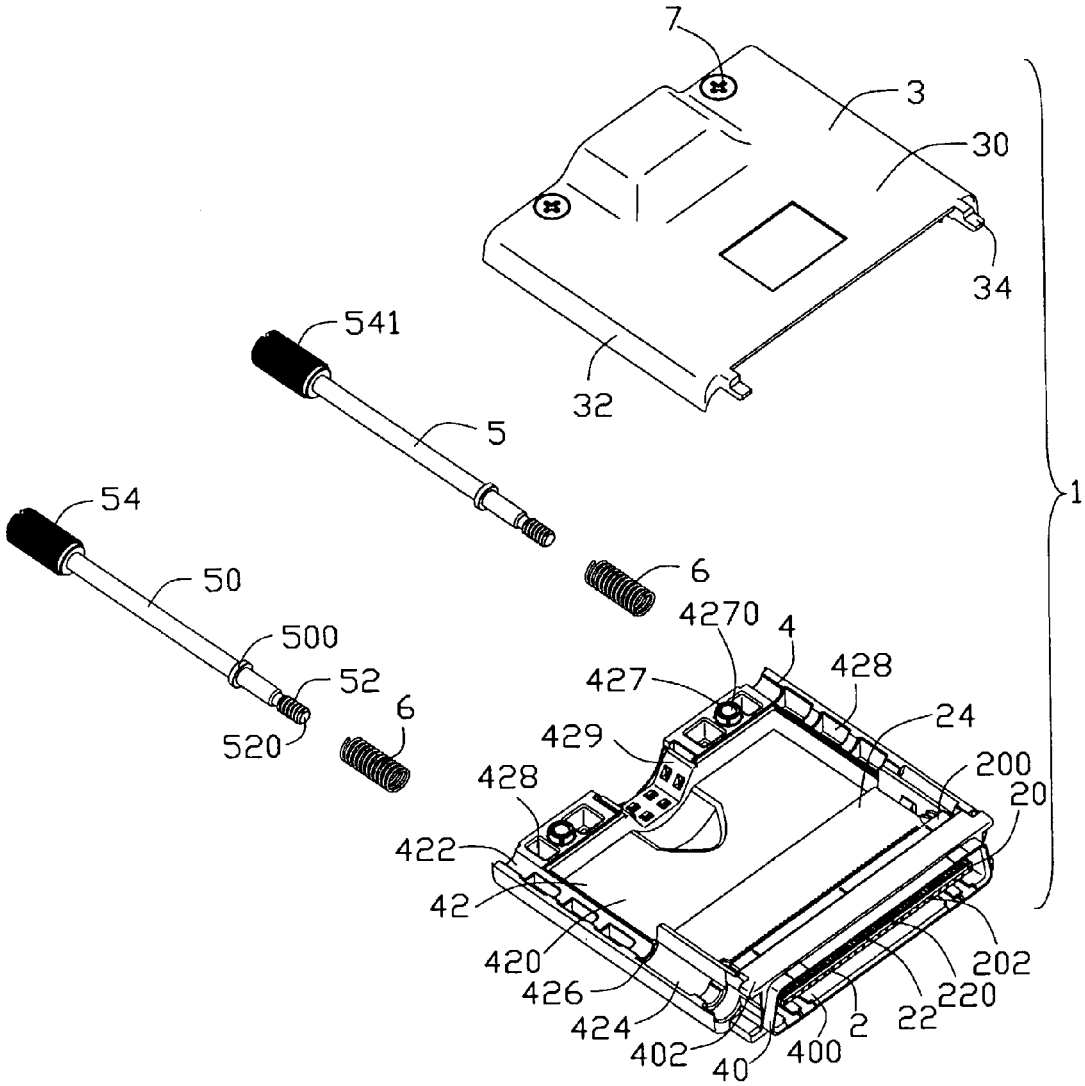
FIG. 1 is a partially exploded perspective view of a cable end connector in accordance with the present invention.
Figure 2:
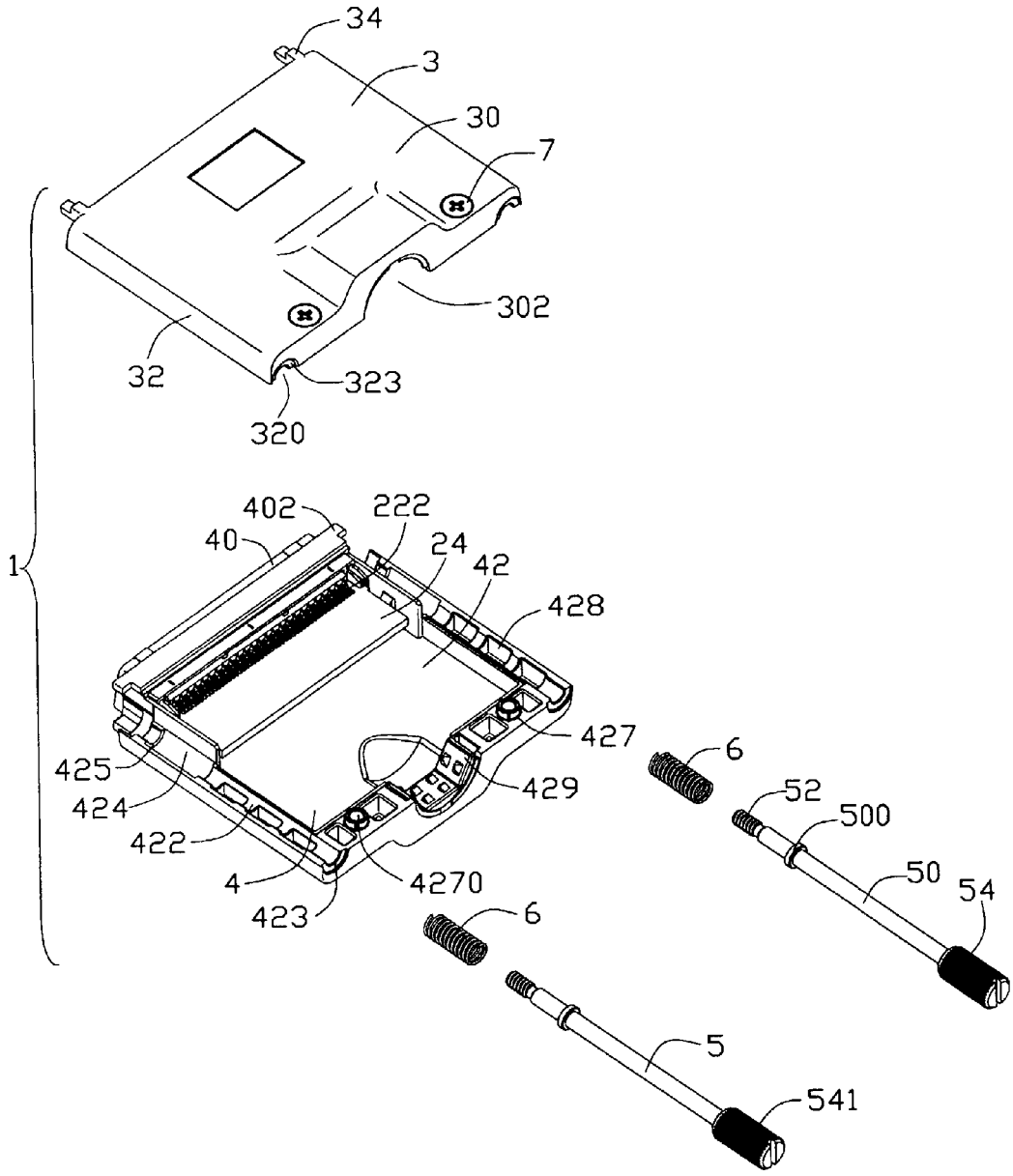
FIG. 2 is a view similar to FIG. 1 but taken from a different perspective.

Referring to FIGS. 1 and 2, a cable end connector 1 in accordance with the present invention comprises a contact module 2, an upper die cast cover 3, a lower die cast cover 4, a pair of fastening members 5, a pair of spring members 6 and a pair of screws 7.

The contact module 2 terminates to an electrical cable (not shown) and comprises an insulating housing 20, a plurality of contacts 22 and a printed circuit board 24. The insulating housing 20 comprises a base portion 200, a tongue portion 202 extending forwardly from the base portion 200 and a plurality of passageways (not labeled) extending from the tongue portion 202 through the base portion 200.

The contacts 22 are received in the passageways of the insulating housing 20. Each contact 22 comprises a contacting portion 220 retained in the tongue portion 202 for contacting with a complementary connector (not shown) and a connecting portion 222 extending in a direction opposite to the contacting portion 220 beyond a rear face of the base portion 200.

The printed circuit board 24 is assembled to the base portion 200 of the insulating housing 20 and is straddled by and electrically connected with the connecting portions 222 of the contacts 22 at one end thereof.

Figure 9:
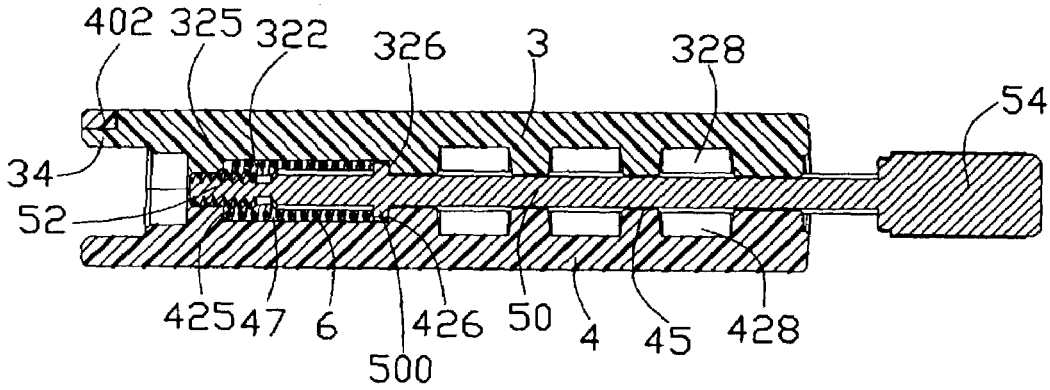
FIG. 9 is a cross-sectional view of the cable end connector taken along line 9—9 in FIG. 7.

The upper cover 3 comprises a generally planar body portion 30, a pair of flanges 32 extending downwardly from opposite lateral sides of the body portion 30 and a pair of spaced fingers 34 extending forwardly from a front end of the body portion 30. The body portion 30 defines a first substantially semicircular opening 302 at a rear end thereof and a pair of through holes (not shown) on opposite sides of the opening 302. Each flange 32 defines a first channel 320 extending through the front and the rear ends thereof and a first depression 323 at the rear end thereof in communication with the first channel 320. Referring to FIG. 9, the first channel 320 comprises a first recessed section 322 adjacent to a front portion thereof. The first recessed section 322 recesses more deeply and widely than other portions of the first channel 320 and defines a front end 325 and an opposite rear end 326 respectively connecting with front and rear portions of the first channel 320. The body portion 30 defines a plurality of cutouts 328 to reduce the weight of the upper cover 3.

The lower cover 4 comprises a mating frame 40 defining a cavity 400 therein and a cover body 42 extending rearwardly from the mating frame 40. The mating frame 40 has a pair of engaging ears 402 extending laterally outwardly from a top portion thereof. The cover body 42 defines a space 420 in communication with the cavity 400, a pair of second channels 422 at opposite lateral sides thereof and a pair of second depressions 423 at a rear end thereof in communication with the second channels 422. The second channels 422 extend through a whole length of the cover body 42. Each second channel 422 comprises a second recessed section 424 corresponding to the first recessed section 322 of the first channel 320. The second recessed section 424 recesses more deeply and widely than other portions of the second channel 422 and defines a front end 425 and an opposite rear end 426 respectively connecting with front and rear portions of the second channel 422. A pair of posts 427 protrudes upwardly adjacent to the rear end of the cover body 42 with a screw hole 4270 defined therein. The cover 42 defines a plurality of cutouts 428 to reduce the weight of the lower cover 4 and a second substantially semicircular opening 429 at the rear end thereof.

Each of the fastening member 5 is generally cylindrical and is called jackscrew. The fastening member 5 comprises an elongated medial portion 50, a threaded portion 52 extending forwardly from the medial portion 50 and an operating portion 54 extending rearwardly from the medial portion 50. The medial portion 50 is formed with an annular stop section 500 protruding outwardly from a circumferential periphery of the medial portion 50. The operating portion 54 has a contacting section 540 (FIG. 3) adjacent to the medial portion 50. An outer surface 541 of the operating portion 54 is slotted for increasing a friction between fingers of a user and the operating portion 54 when the user grabs the operating portion 54.

Figure 3:
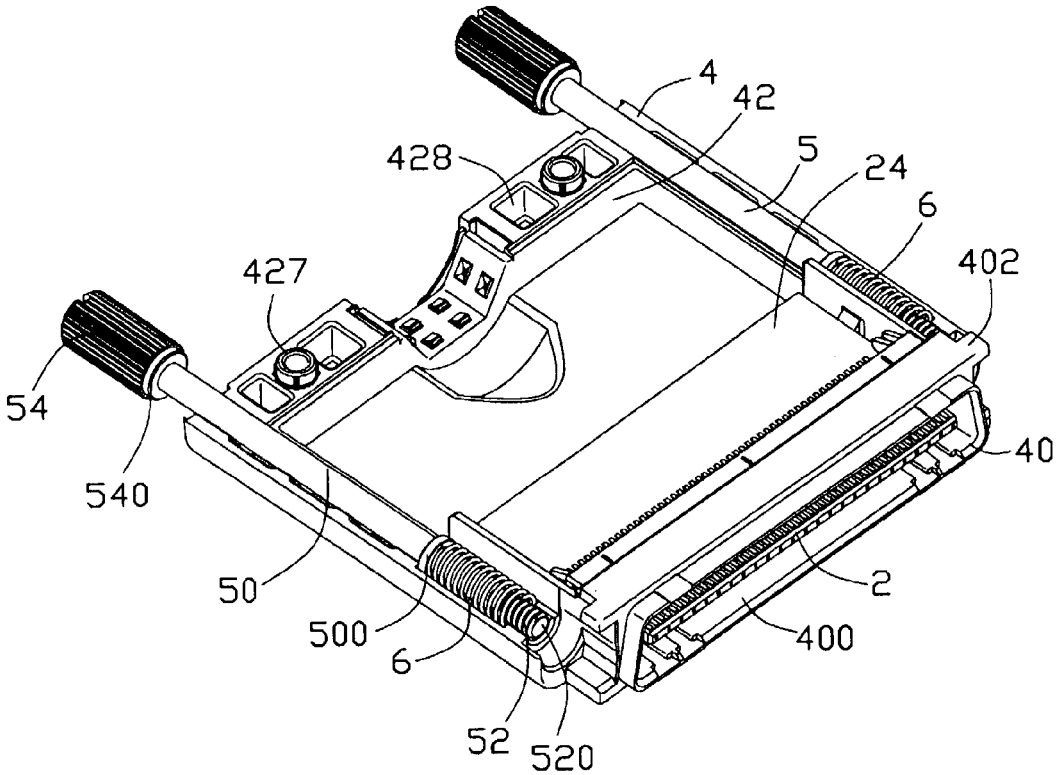
FIG. 3 is a partially assembled perspective view of FIG. 1 without an upper cover thereof to clearly show a pair of jackscrews thereof in an original position.

Referring to FIG. 3, in assembly, the contact module 2 is assembled in the lower cover 4 with the tongue portion 202 having the contacting portions 220 thereon being accommodated in the cavity 400 of the mating frame 40 and the printed circuit board 24 extending into the space 420.

The fastening members 5 are disposed in the second channels 422 of the lower cover 4 with the stop sections 500 being located in the second recessed sections 424.

Each of the spring members 6 is disposed on a corresponding fastening member 5. When the fastening member 5 is disposed in the second channel 422, the spring member 6 is received in a corresponding second recessed section 424 with one end abutting against the stop section 500 of the fastening member 5 and another end abutting against the front end 425 of the second recessed section 424.

Referring to FIGS. 5–9, the upper cover 3 is assembled to the lower cover 4 with the fingers 34 partially extending below the engaging ears 402 to engage with the engaging ears 402. The posts 427 of the lower cover 4 are received in the through holes of the upper cover 3. The upper and lower openings 302, 429 together form a cable exit 46 for the extension of the cable. Finally, the screws 7 extend through the through holes of the upper cover 3 into the screw holes 4270 of the lower cover 4 to securely fasten the upper and lower covers 3, 4 together. In such a way, the cable end connector 1 is assembled together. The fastening members 5 are movably and rotatably received in passages 45 formed by the first channels 320 of the upper cover 3 and the second channels 422 of the lower cover 4. The stop sections 500 and the spring members 6 are movably accommodated in engaging sections 47 (FIG. 9) formed by the first recessed sections 322 and the second recessed sections 424.

Figure 4:
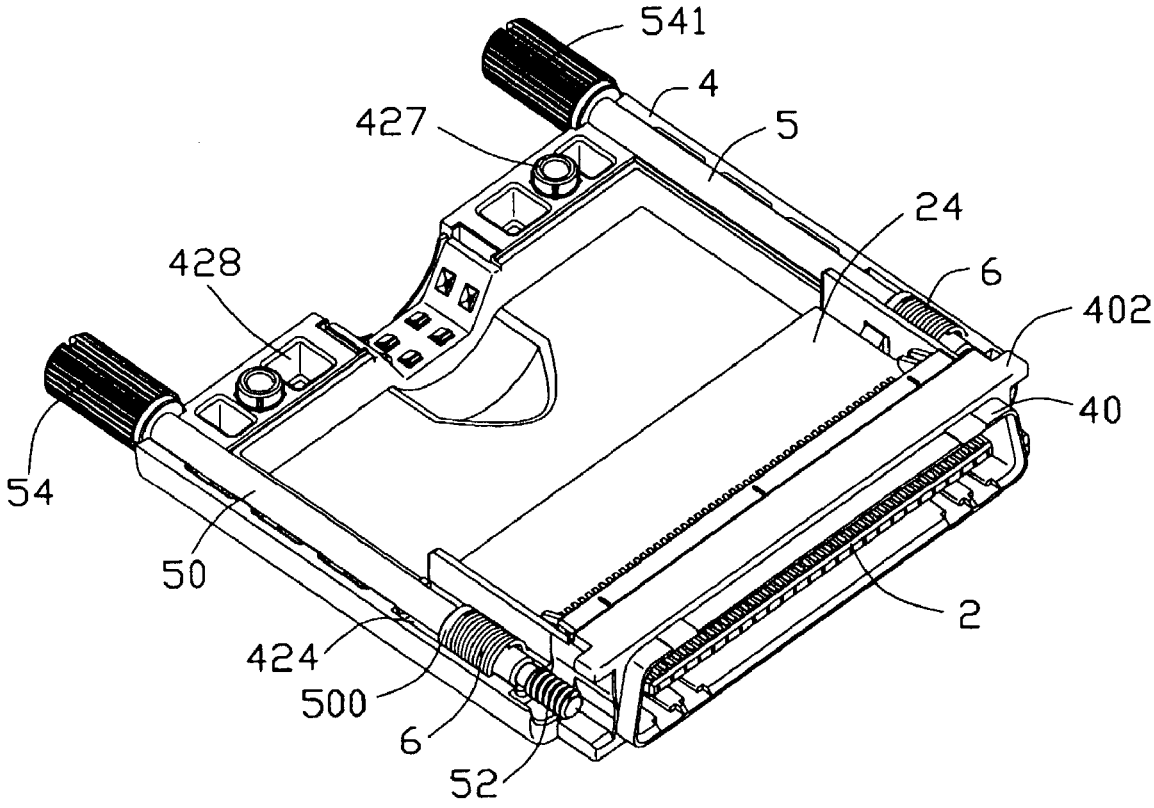
FIG. 4 is a view similar to FIG. 3 but showing the pair of jackscrews in a final position.
Figure 5:
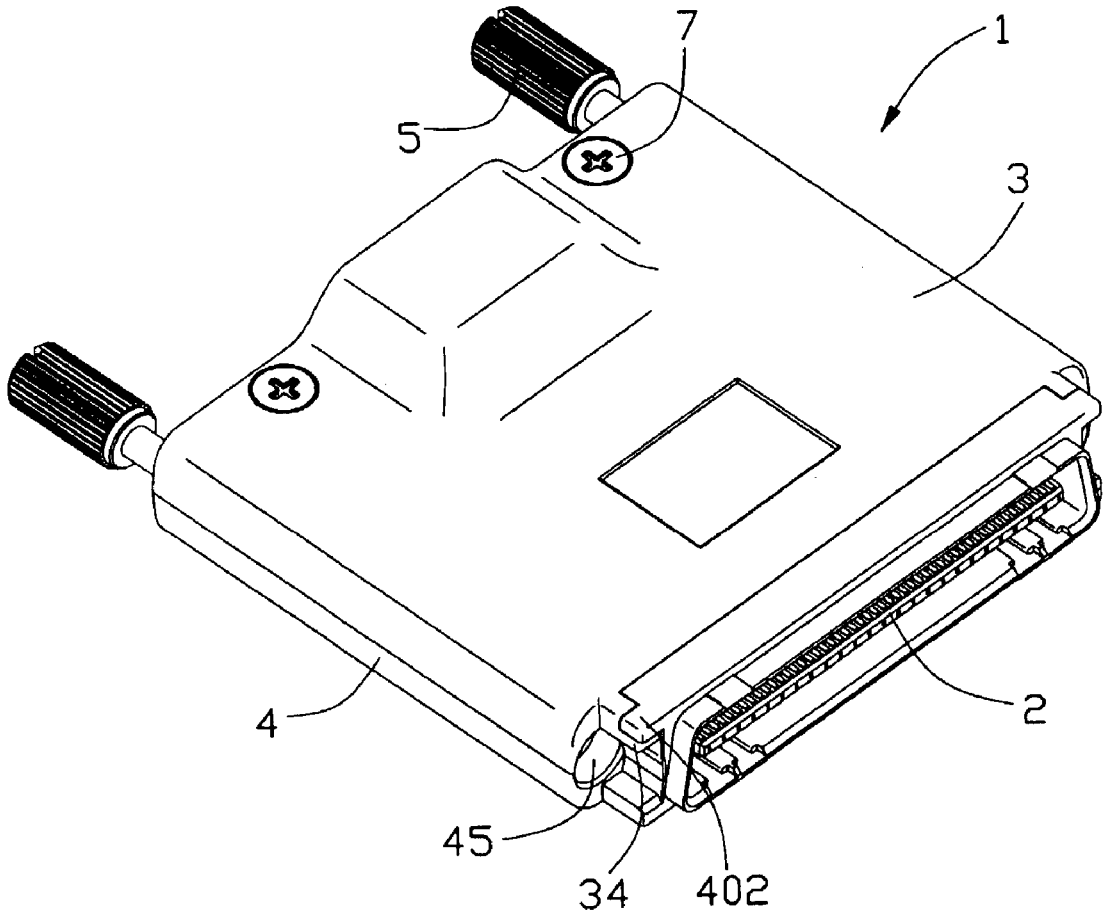
FIG. 5 is an assembled perspective view of the cable end connector shown in FIG. 1.
Figure 6:
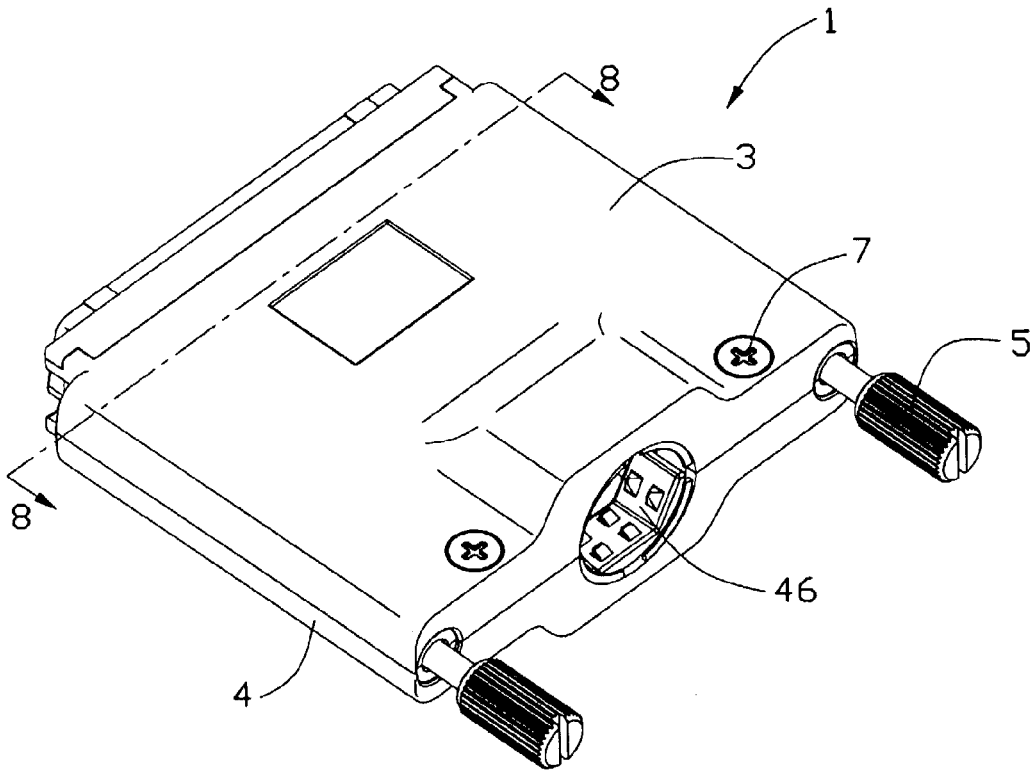
FIG. 6 is an assembled perspective view of the cable end connector shown in FIG. 2.
Figure 7:
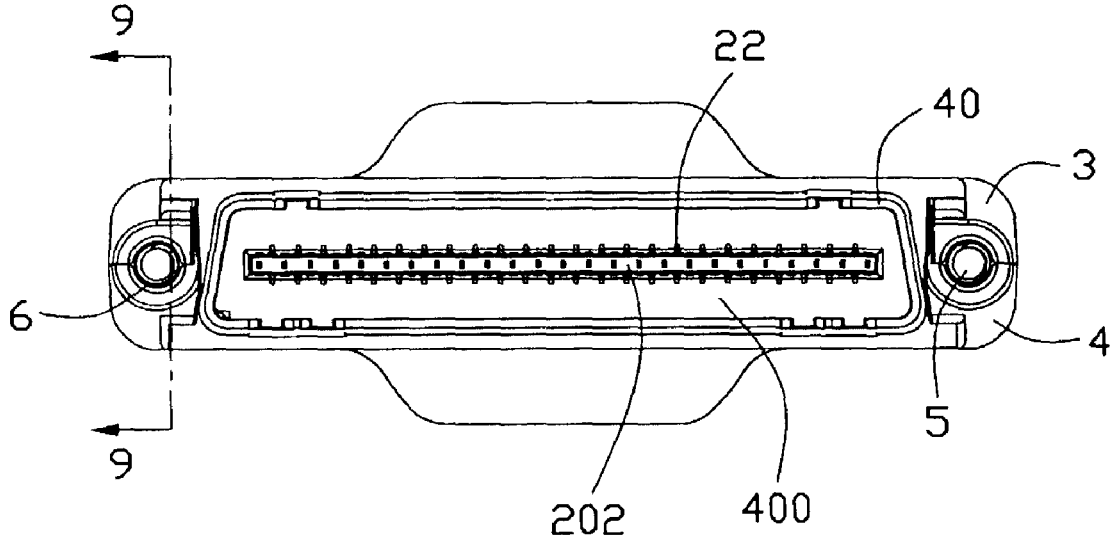
FIG. 7 is a front planar view of the cable end connector shown in FIG. 5.
Figure 8:
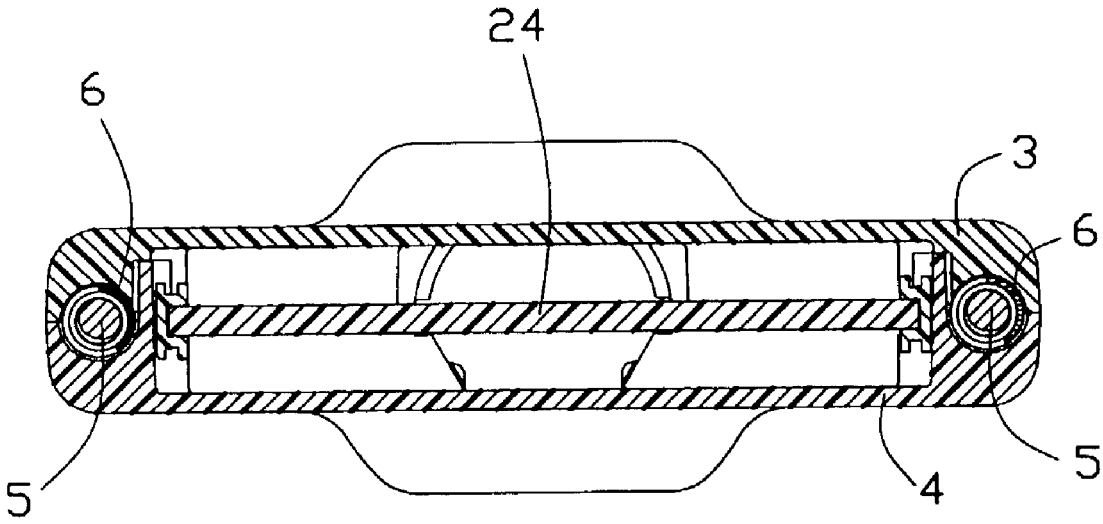
FIG. 8 is a cross-sectional view of the cable end connector taken along line 8—8 in FIG. 6.

Further referring to FIG. 9 in conjunction with FIG. 3 and 4, in use, when the cable end connector 1 is to be interconnect with the complementary connector, the operating portion 54 of the fastening member 5 are accessed by the user to push the fastening member 5 forwardly. The stop sections 500 move forwardly from the rear ends 326, 426 of the recessed sections 322, 424 until the contacting section 540 of the operating portions 54 are received in the depressions 323, 423 of the upper and lower covers 3, 4. Due to the forward movement of the stop sections 500, the spring members 6 are compressed to be snugly located between the stop sections 500 and the front ends 325, 425 of the recessed sections 322, 424. The threaded portions 52 are rotated by rotating the operating portions 54 to thus engage with locking nuts of the complementary connector, whereby an interconnection is established between the cable end connector 1 and the complementary connector.

If the screw connection between the cable end connector 1 and the complementary connector become loosened due to vibration/physical shock during use, the spring member 6 automatically resumes to its original shape to motivate the fastening member 5 to move rearwardly until the stop section 50 abuts against the rear ends 325, 425 of the recessed sections 322, 424. Thus, the loose connection between the cable end connector 1 and die complementary connector can be easily detected, whereby the user can immediately secure the cable end connector 1 with the complementary connector to ensure a reliable engagement therebetween.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable end connector for use with a complementary connector, comprising:

a cover device defining a first front face with a mating shroud extending forwardly beyond the first front face;

an insulative housing enclosed and located in a front portion of the cover device;

a plurality of contacts disposed in the housing and exposed, in the mating shroud;

at least one channel defined in the cover device and extending rearward from a second front face of the cover device along a front-to-back direction and beside the housing, said second front face being behind the first front face in said front-to-back direction;

a fastening member located in the channel and having a threaded head at a front end thereof for fastening to the complementary connector, said threaded head being rearwardly retracted within the cover device when said fastening member is in an unemployed position;

a biasing member including a portion located in the channel to constantly urge the fastening member rearwardly so as to assure that said threaded head is rearwardly retracted behind the second front face of the cover device when said fastening member is in an unemployed position; wherein at least one plate integrally extending outwardly and transversely from a portion of the cover device and located between the first front face and the second front face so as to partially protect the fastening member when said fastening member is in an employed position.

2. The cable end connector as claimed in claim 1, further comprising a printed circuit board assembled to the housing and received in the cover device, and wherein the printed circuit board electrically connect with the contacts adapted for electrically connecting the contacts with a cable.

3. The cable end connector as claimed in claim 1, wherein the plate connects with the first front face of the cover device.

4. The cable end connector as claimed in claim 1, wherein the fastening member comprises a stop section close to said threaded head thereof, and wherein said biasing member is located adjacent to the front end of the fastening member and imposes rearward forces upon the stop section of the fastening member.

5. The cable end connector as claimed in claim 4, wherein the stop section of the fastening member extrudes outwardly from outer periphery of the front end of the fastening member.

6. A cable end connector for use with a complementary connector, comprising:

a cover device defining a first front face with a mating shroud extending forwardly beyond the first front face;

an insulative housing enclosed and located in a front portion of the cover device;

a plurality of contacts disposed in the housing and exposed in the mating shroud;

at least one channel defined in the cover device and extending rearward from a second front face of the cover device along a front-to-back direction and beside the housing, said second front face being behind the first front face in said front-to-back direction;

a fastening member located in the channel and having a threaded head at a front end thereof for fastening to the complementary connector, said threaded head being rearwardly retracted within the cover device when said fastening member is in an unemployed position;

a biasing member including a portion located in the channel to constantly urge the fastening member rearwardly so as to assure that said threaded head is rearwardly retracted behind the second front face of the cover device when said fastening member is in an unemployed position; wherein said biasing member is located adjacent to the front end of the fastening member and imposes rearward forces upon a front portion of the fastening member close to said threaded head.

7. The cable end connector as claimed in claim 6, further comprising a printed circuit board and straddled by connecting portions of the contacts.

8. The cable end connector as claimed in claim 6, wherein the cover device further defines an engaging section recessed from the channel to receive the front end of the fastening member and the biasing member.

9. The cable end connector as claimed in claim 8, wherein the front portion of the fastening member and the end away from the front portion of the biasing member respectively compressedly abutting against opposite ends of the engaging section.

10. A cable end connector for use with a complementary connector, comprising:

a cover device defining a first front face with a mating shroud extending forwardly beyond the first front face;

an insulative housing enclosed and located in a front portion of the cover device;

a plurality of contacts disposed in the housing and exposed in the mating shroud;

at least one channel defined in the cover device and extending rearward from a second front face of the cover device along a front-to-back direction and beside the housing, said second front face being behind the first front face in said front-to-back direction;

a fastening member located in the channel and having a threaded head at a front end thereof for fastening to the complementary connector, said threaded head being rearwardly retracted within the cover device when either said fastening member is in an unemployed position;

a biasing member including a portion located in the channel to constantly urge the fastening member rearwardly so as to assure that said threaded head is rearwardly retracted behind the second front face of the cover device when said fastening member is in an unemployed position.

* * * * *